US005452535A

United States Patent [19]

See et al.

[11] Patent Number: 5,452,535

[45] Date of Patent: Sep. 26, 1995

[54] SHOTGUN SHELL WAD/SHOT CUP RETARDING DEVICE

[75] Inventors: Michael See, Scott City, Kans.; Michael Rock, Albany; Ronald N. Walker, Cobb, both of Wis.

[73] Assignee: Impromark, Inc., Dodgeville, Wis.

[21] Appl. No.: 73,325

[22] Filed: Jun. 4, 1993

[51] Int. Cl.[6] ..... F41A 21/40

[52] U.S. Cl. ..... 42/79; 89/14.6

[58] Field of Search ..... 89/14.6; 42/79

[56] References Cited

U.S. PATENT DOCUMENTS

| | | | |
|---|---|---|---|
| 85,949 | 1/1869 | McKenzie | 42/79 |
| 587,801 | 8/1897 | Durnford | 42/79 |
| 889,644 | 6/1908 | Szemerey | 89/14.6 |
| 1,858,560 | 5/1932 | Rosenstiel | 42/79 |
| 2,092,649 | 9/1937 | Jung | 42/79 |
| 2,098,617 | 11/1937 | Cutts, Jr. | 42/79 |
| 2,447,205 | 8/1948 | Powell | 42/79 |
| 2,453,121 | 11/1948 | Cutts | 42/79 |
| 2,658,298 | 11/1953 | Oberfell | 42/79 |
| 2,811,901 | 11/1957 | Barr | 89/14.6 |
| 2,861,375 | 11/1958 | Rodick | 42/79 |
| 2,922,242 | 1/1960 | Pachmayr et al. | 42/79 |
| 2,984,926 | 5/1961 | Havlin | 42/79 |
| 3,045,378 | 7/1962 | Denaux | 42/79 |
| 3,045,379 | 7/1962 | Cutts | 42/79 |
| 3,138,991 | 6/1964 | Malter | 89/14.6 |
| 3,161,979 | 12/1964 | Lowe | 42/79 |
| 3,400,661 | 9/1968 | Coon et al. | 89/14.6 |
| 3,427,648 | 2/1969 | Manning et al. | 89/14.6 |
| 3,492,750 | 2/1970 | Ashbrook et al. | 42/79 |
| 3,496,667 | 2/1970 | Lowry | 42/79 |
| 3,605,313 | 9/1971 | Kranz | 42/79 |
| 3,724,376 | 4/1973 | Kordas et al. | 89/14.6 |
| 3,769,731 | 11/1973 | Pachmayr et al. | 42/79 |
| 3,797,155 | 3/1974 | Smith et al. | 42/79 |
| 3,812,610 | 5/1974 | Kranz | 42/79 |
| 4,008,538 | 2/1977 | Center | 42/79 |
| 4,040,331 | 8/1977 | Litman | 89/14.6 |
| 4,058,925 | 11/1977 | Linde et al. | 42/79 |
| 4,071,971 | 2/1978 | Tornas | 42/79 |
| 4,151,671 | 5/1979 | McPeak | 42/79 |
| 4,711,048 | 12/1987 | Ashbrook | 42/79 |
| 4,713,903 | 12/1987 | Mainland | 42/79 |
| 5,157,211 | 10/1992 | Mossberg | 42/79 |
| 5,309,814 | 5/1994 | Mossberg | 89/14.6 |

FOREIGN PATENT DOCUMENTS 997788 1/1952 France .

*Primary Examiner*—Charles T. Jordan

*Attorney, Agent, or Firm*—Hill, Steadman & Simpson

[57] ABSTRACT

A shot cup retardation device including circumferentially spaced and radially protruding ridges, pins, studs, or set screws; or an applied grit around an inner circumference of a barrel; or a plurality of continuous circumferential ribs arranged axially spaced apart within the barrel, all for retarding the velocity of a shot cup so as to inhibit interference between shot and cup downstream of the shotgun muzzle. Additionally, the invention provides that a shot cup retardation device and a downstream choke or pattern conditioner can be utilized in combination to produce a fine tuned and selective pattern without the random influence of shot cup and shot interference.

19 Claims, 3 Drawing Sheets

SHOTGUN SHELL WAD/SHOT CUP RETARDING DEVICE

BACKGROUND OF THE INVENTION

This invention relates to shot pattern controlling devices for mounting or otherwise connected to a barrel of a shotgun. Particularly, the patent relates to devices for retarding the velocity of a wad/shot cup so as not to interfere with the shot or pellets emanating from the muzzle of the shotgun, producing a tighter or more compact pattern.

It is known to provide pins, discs, or spheres for protruding into a barrel of a shotgun to retard a fiber wad traveling down the barrel. U.S. Pat. No. 2,092,649 shows these features. It is also known to provide a semiannular rib in conjunction with a nozzle to cause wad retardation by imparting a spin to the wad as it progresses down the nozzle. U.S. Pat. No. 3,045,379 also discloses these features. It is also known to provide conventional chokes on a shotgun muzzle which offer a constriction or a constriction followed by an expansion to adjust the spray pattern. These restrictions can also slow down a wad traveling down the barrel but they apply radial forces to the shot pellets, thereby distorting the resulting pattern.

Because of pollution concerns, the use of lead shot may soon be restricted or outlawed. Lead is a soft metal which does not drastically wear the inside bore of a shotgun during firing. As an alternate to lead, other shot materials such as steel, zirconia, bismuth, etc., have the disadvantage of being sufficiently hard to wear or damage the inside surface of the barrel during discharge. Hence, in modern applications, shot is carried in a plastic shot cup formed as one piece with the wad separating the powder charge from the shot pellets to protect the inside surface of the barrel during discharge. However, it has been found that the shot cup, which is designed to split open near the muzzle end of the barrel or just outside the muzzle end of the barrel, left unretarded, can accelerate into the projecting shot or tip or twist before all of the shot pellets have left the shot cup, thus detrimentally affecting the shot pattern, e.g., making the pattern wider. Modern venturi or orifice chokes can act to retard the carrier cup, but additionally also affect the shot pattern.

Where a restriction such as a choke is used to retard the carrier cup, the choke adversely affects the shot pattern and in some cases makes the pattern too concentrated for effective shotgun hunting of game at a distance. Additionally, if the game is too close, an overly concentrated pattern will so destroy the game that it is not useable for food or otherwise.

It is not known to provide a protuberance-type wad retardation zone for use with modern plastic shot wad casings or shot carrier cups.

It is also not known in the art to provide a protuberance-type wad retardation zone followed by a choke or shot spreader in a downstream zone of the barrel.

SUMMARY OF THE INVENTION

It is an object of the present invention to provide a shot wad/shot cup retardation zone of an improved design. It is also an object of the present invention to provide a shot wad/shot cup retardation zone followed by a shot pattern conditioning zone such as a choke or shot spreader. It is an object of the present invention to provide an economically manufactured and effective shot wad/shot cup retardation device effective for a long life in which damage to the retardation device by the shot is avoided or minimized.

These objects are inventively achieved in one embodiment where the shot wad/shot cup retardation device provides lengthwise arranged ridges having inclined faces facing the oncoming shot wad/shot cup for a gradual increase or sharp increase of radial gripping and friction of the shot wad/shot cup passing thereby. The object is inventively achieved in a further embodiment where the shot wad/shot cup retardation device comprises a hard grit of metallic or ceramic particles affixed to an inside surface of a barrel extension for frictionally engaging the shot wad/shot cup as it passes thereby to effect retardation.

The objects are inventively achieved in a further embodiment where a plurality of set screws, studs or other fixed or adjustable members are arranged in a barrel or barrel extension, the set screws (etc.) protrude into the barrel to engage the shot wad/shot cup passing thereby. The objects are inventively achieved in a further embodiment wherein the shot wad/shot cup retardation device comprises a plurality of ribs arranged around the perimeter of the inside circumference of a barrel extension, the ribs providing the frictional retardation of the shot wad/shot cup passing thereby. In a further embodiment, the shot gun barrel or a barrel extension provides rifling having a progressively decreasing inside clearance diameter for progressively gripping an outside circumference of the shot wad/shot cup as it progresses down the barrel.

The objects of the invention are further achieved in that the barrel extensions providing the shot wad/shot cup retardation devices can further include either integrally or by means of a connection thereon, a choke device of a permanent or adjustable configuration, or a shot spreader device. By providing a spreader device at the downstream side of the shot wad retardation device, over-concentration of the shot due to the effective removal of the shot wad/shot cup as a pattern spreader can be avoided and adequately controlled by the application of the spreader. A fine-tuned and controlled pattern can be achieved with the use of both a retardation zone and a spreader or choke in series.

DETAILED DESCRIPTION OF THE PREFERRED EMBODIMENTS

Figure 1:
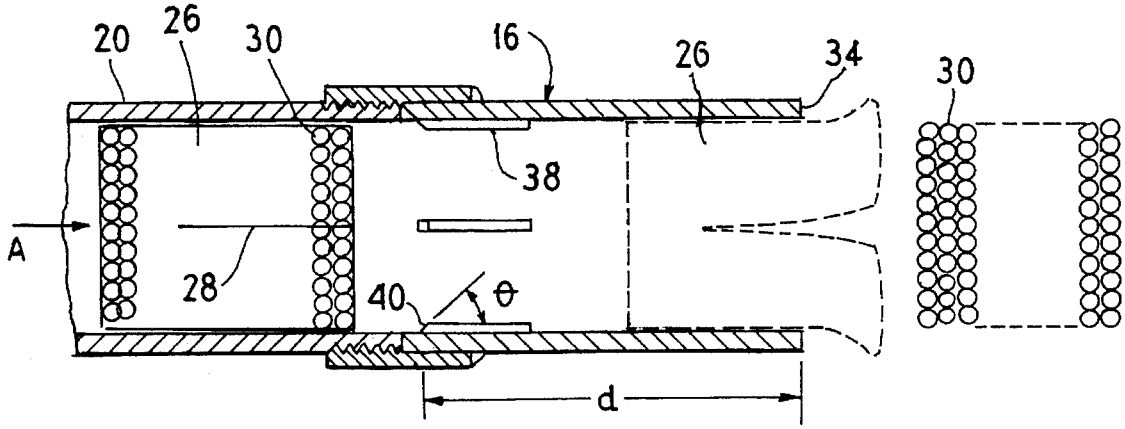
FIG. 1 is a longitudinal sectional view of an end portion of a shotgun barrel of the present invention.

FIG. 1 shows a shotgun shell wad/shot cup retardation device 16, according to the present invention, mounted onto a shotgun barrel 20. Although the retardation device 16 is shown as a separate piece mounted to the barrel 20, it is within the scope of the invention to provide that the retardation device 16 and the barrel 20 are integrally formed. A shot wad/shot cup 26 which is formed of a high density plastic is shown progressing in a direction A down the barrel 20 at high velocity. The shot wad/shot cup 26 provides a plurality of axial slits 28 for opening up a lead end of the wad/cup to release the shot 30 in a column form from its containment within the wad/cup. Without a retardation device 16, the wad/cup 26, when exiting from a muzzle end 34 of the shotgun, can trail the shot 30 closely and in fact be accelerated into the shot column when the wad/cup leaves the muzzle 34, so as to detrimentally affect its distribution. Also, the wad/cup may begin to tip or twist before all of the shot has left the wad/cup, further distorting the pattern. By retarding the wad/cup 26, the shot can proceed from the muzzle 34 in a tighter, more confined pattern without being affected by the wad/cup which will fall away much faster. Further, the expanding gasses will be retained in the gun barrel longer by the wad/cup 26, thus preventing dispersal of the shot pellets by the gasses as they subsequently exit the barrel.

In an embodiment of the invention, the retardation device 16 comprises a plurality of angularly disposed protuberances which may be in the form of ridges 38 having inclined lead ends 40 described by the angle Θ. The angle Θ can range from 90° to 0° and the lead area can be a linear or arcuate slope. The ridges are preferably spaced approximately a distance d=0.05 to 6 inches from the muzzle 34. The ridges may be rectangular in shape being longer in axial length or longer in angular length, as desired. As shown in FIG. 1, after the cup 26 has passed by the ridges 38, it has been retarded with respect to the shot 30 and does not exert significant influence on the more rapidly travelling shot 30. The ridges 38 can be formed by first broaching an inside diameter of the retardation device 16 and then reaming into the device from opposite ends to the axial beginning and end of the ridges 38.

Unlike previously used fiber or cardboard wads, which began to disintegrate or severely deform upon engaging any protrusion or construction within the gun barrel, the high density plastic carriers retain their integrity. The high gas pressures within the barrel behind the traveling carrier, combined with the inertia of the carrier and the shot load, cause the carrier to obturate or swell to completely fill and seal the barrel keeping the expanding gases behind the carrier. When the carrier engages the protuberances within the barrel, a deformation of the plastic occurs beyond simple friction since the plastic is strain rate sensitive. The selected radial and longitudinal length of the protuberances along with the axial length of the carrier and the axial placement of the protuberances within the barrel are selected to retard the carrier by a sufficient amount to permit the shot column to completely exit from the carrier cup and move a sufficient distance away from the carrier cup so that reacceleration of the carrier cup as it exits from the barrel will be insufficient to permit the carrier cup to "catch up" to the shot column which then would be receding from the end of the barrel. Also, the petals of the slit cup will open up much more rapidly with an empty or semi-empty shot cup.

Figure 2:
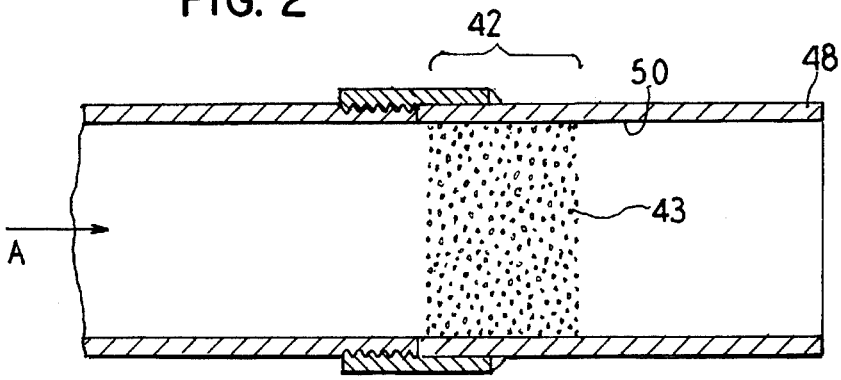
FIG. 2 is a longitudinal sectional view of an alternate embodiment of an end portion of a shotgun barrel of the present invention.

FIG. 2 shows an alternate embodiment where a zone 42 of grit 43 is applied to an inside surface of a barrel extension 48 to form the protuberances. The grit 43 could easily be applied to the barrel itself as an integral unit and such is within the scope of the invention. However, by applying the grit 43 to a removable barrel extension, after a number of uses the extension 48 can be replaced. The grit 43 can comprise metallic or ceramic material adhered strongly to an inside surface 50 of the extension 48. Preferred materials for the grit include tungsten carbide, hardened steel, cermet or ceramic, etc. After the grit has been applied, the interior of the barrel or barrel extension can be electro plated to provide a protective coating over the grit to enhance the life of the retardation device. As the wad/cup 26 (not shown) travels past the grit 43, the grit frictionally retards the wad/cup 26 and has minimum effect on the shot 30 which remains protected inside the wad/cup as the wad/cup engages the grit.

Figure 3:
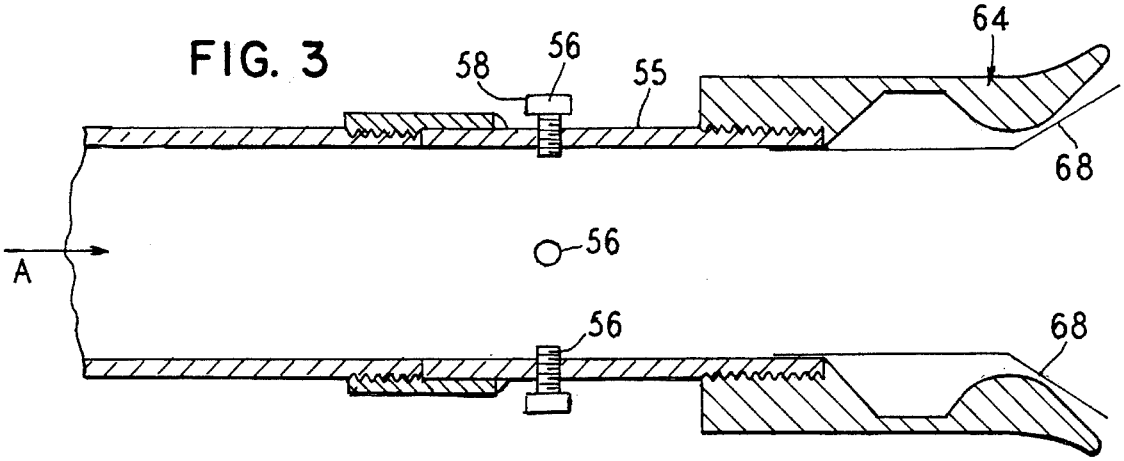
FIG. 3 is a longitudinal sectional view of an alternate embodiment of an end portion of a shotgun barrel of the present invention.

FIG. 3 shows a further embodiment of the invention, wherein a plurality of set screws 56 are arranged around the barrel for protrusion into the barrel to interfere with the wad/cup 26 (not shown) passing thereby. Each set screw has a head portion 58 which can have a dial applied thereon for proper setting of all set screws for radial symmetry. Alternately, pins, rivets, studs, etc. having a square, rectangular, circular or other shaped cross section could be mounted on the barrel or barrel extension in a fixed radial position to engage the wad/cup to a predetermined degree. Any number of rows and columns of the protuberances could be provided. Additionally, FIG. 3 shows a shot spreader 64 removably attached to the retardation device 55. Working in combination with the retardation device 55, the shot spreader receives the concentrated grouping of shot 30 and expands the shot according to the velocity profile 68 in a controlled expansion, free of interference of the wad/cup 26. Thus, in conjunction with the retardation device 55 and the shot spreader 64, a fine tuned control pattern can be obtained.

Figure 4:
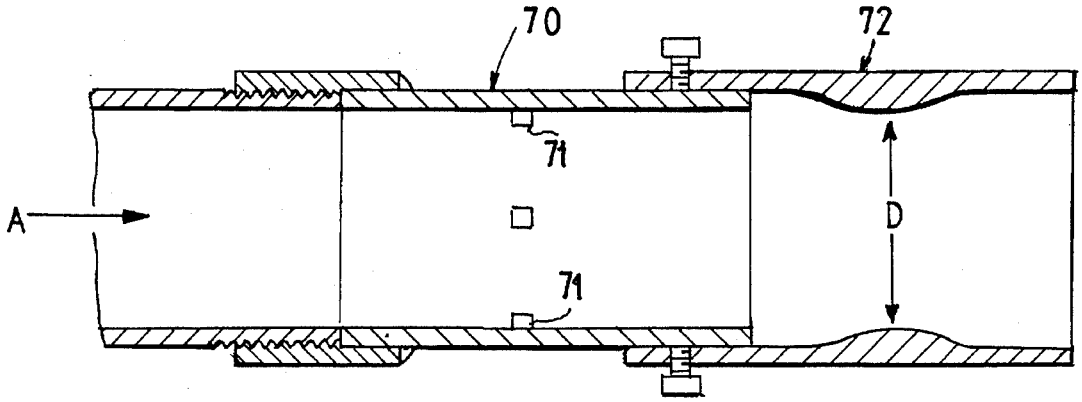
FIG. 4 is a longitudinal sectional view of an alternate embodiment of an end portion of a shotgun barrel of the present invention.

FIG. 4 shows a further embodiment, wherein a shot wad/cup retardation device 70 having square protuberances 71 of any selected number and size has applied thereto a choke 72 as known in the art such as U.S. Pat. No. 3,605,313 or U.S. Pat. No. 2,984,926, for conditioning the shot concentration deriving from the wad/cup retardation device 16. The choke diameter D can be chosen to properly condition the shot pattern or can be made adjustable as is known in the art.

Figure 5:
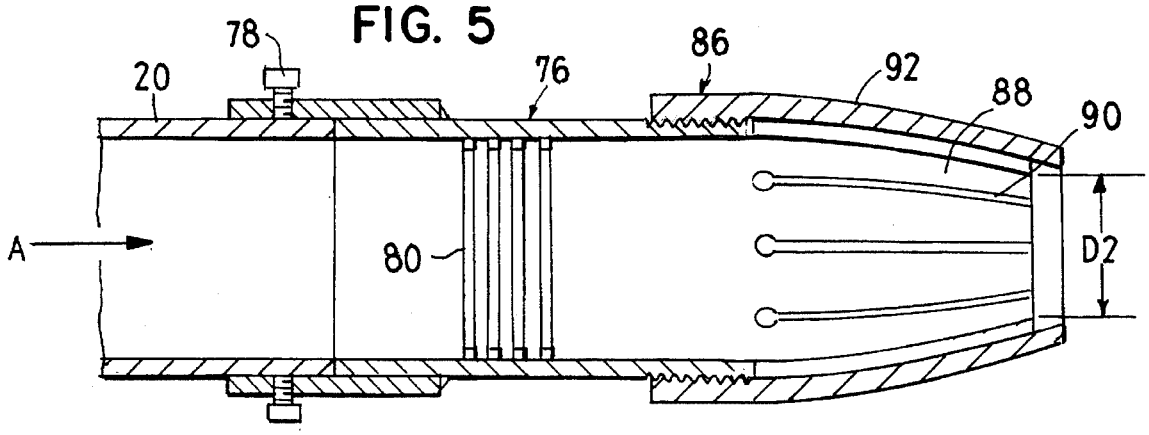
FIG. 5 is a longitudinal sectional view of an alternate embodiment of an end portion of a shotgun barrel according to the invention.

FIG. 5 shows a further embodiment of the invention, wherein a shot wad/cup retardation device 76 is attached to the shotgun barrel 20 by set screws 78. This device 76 provides at least one, and preferably a plurality of, circumferential ribs 80 applied along an inside diameter of the device 76. The cup 26 progressing down the barrel will be frictionally retarded by passing over these ribs 80, whereas the shot will be only minimally affected so as to proceed ahead of the wad/cup 26. Attached to the retardation device 76 is an adjustable choke 86 comprising axial finger portions 88 separated by slots 90 with an outside casing 92 threadingly attached to the device 76, progression of the outside casing 92 crimping the axial fingers 88 together to form a more restrictive choke and extending the outside casing 92 from the barrel causing a widening of the diameter of the choke D2, as is known in the art, such as U.S. Pat. No. 3,161,979.

Figure 6:
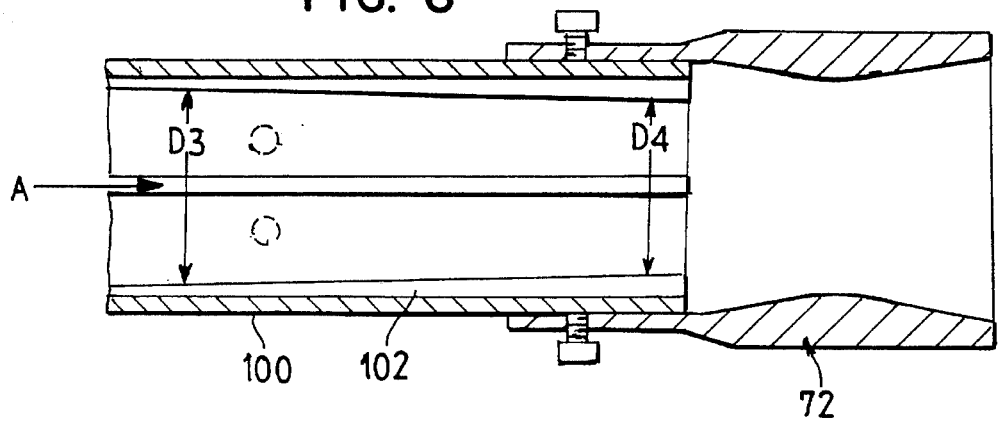
FIG. 6 is a longitudinal sectional view of an alternate embodiment of an end portion of a shotgun barrel according to the invention.

FIG. 6 shows a further embodiment of the invention, wherein the shotgun barrel 100 provides rifling ridges 102 extending axially thereof and spaced radially around the inner circumference of the barrel 100. The rifling ridge thickness progresses in the direction of travel A of the wad/cup such that the clear diameter decreases from D3 to D4. Thus, the wad/cup 26 will be progressively slowed down as it travels through the rifled area whereas the shot will be minimally affected. Also shown attached to the barrel 100 is a choke 72 as is known in the art.

Figure 7:
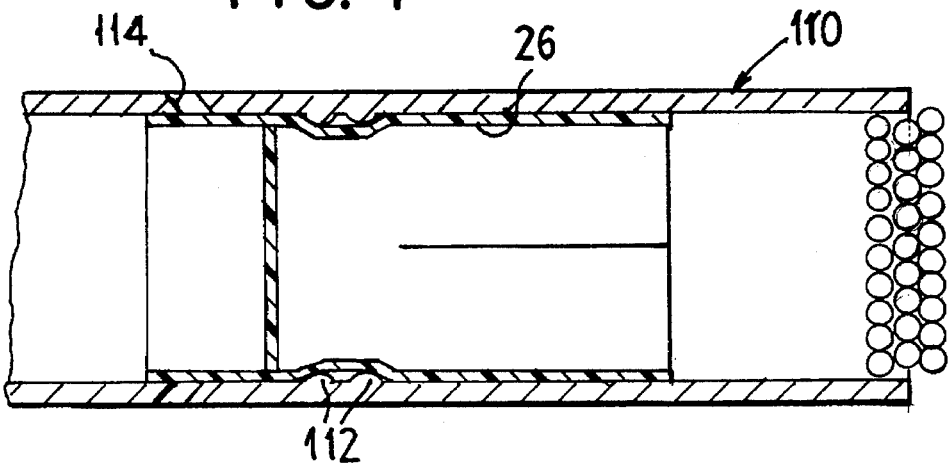
FIG. 7 is a longitudinal sectional view of an alternate embodiment of an end portion of a shotgun barrel according to the invention.

FIG. 7 shows a further embodiment of the invention wherein the shotgun barrel 110 has a plurality of rows of protuberances 112 extending radially thereinto. Positioned upstream of the protuberances are one or more gas ports 114 which may be in the form of circular holes or slits and which may be perpendicular to the axis of the barrel or angled forwardly or rearwardly with respect thereto. Preferably, the position of the gas ports 114 relative to the protuberances 112 is such that the wad/cup 26 will be in radial engagement with the protuberances 112 before the gas ports 114 are exposed to the expanding gas behind the wad/cup. Thus, the ports 114 should not be positioned upstream of the protuberances 112 a distance greater than a length of the wad/cup.

This embodiment allows the expanding gasses to be ported out of the barrel thereby removing any accelerating force which might otherwise be applied to the wad/cup 26 as it approaches the muzzle of the barrel. This will assure that the wad/cup 26 will not be able to be accelerated into or catch up with the shot pellets which have continued unretarded out of the muzzle.

Figure 8:
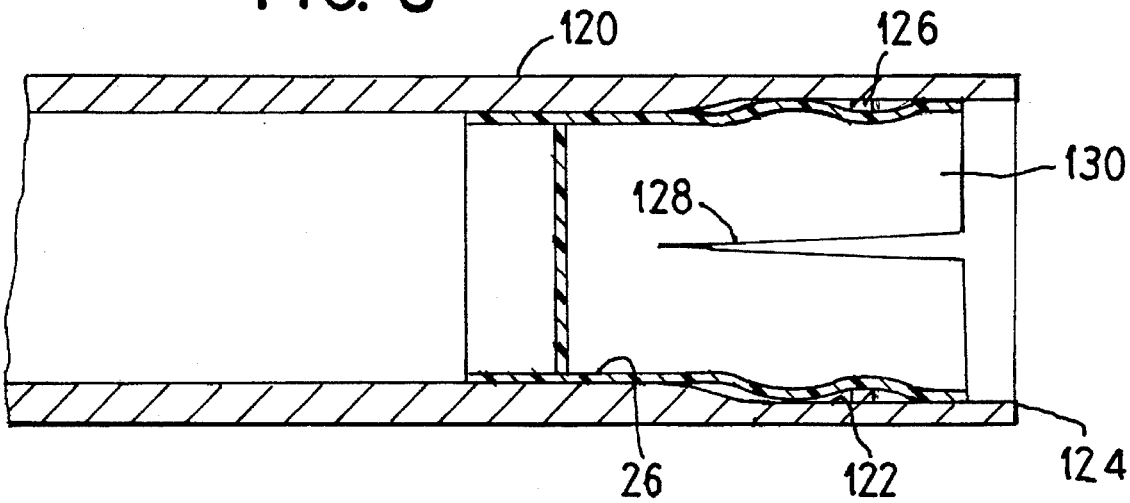
FIG. 8 is a longitudinal sectional view of an alternate embodiment of an end portion of a shotgun barrel according to the invention.

FIG. 8 shows a further embodiment of the invention wherein the shotgun barrel 120 has a radially outwardly stepped internal diameter 122 near a muzzle 124 of the barrel. In the enlarged internal diameter portion there are a plurality of protuberances 126 which project radially inwardly, but, preferably, not a distance greater than an internal diameter of the upstream portion of the barrel 120. Thus, as the wad/cup 26 travels down the barrel, when it engages the increased internal diameter area, it will begin to expand outwardly due to preformed slits 128 formed in the cup portion of the wad/cup. When the individual petals 130 of the wad/cup engage the protuberances 126, the cup will be retarded while the shot (not shown) will continue out of the wad/cup 26 and muzzle 124 without being radially compacted by the protuberances 126. Thus, the shot pellets will not have had any radial compressive forces applied thereto during their passage through the retarding device.

It is to be understood that any of the wad/cup retardation devices can be used with any of the chokes or expanders shown in the various figures in multiple combinations. Additionally, it is within the scope of the invention that any component shown separate can be made integral and those components shown integral could be made separate and replaceable.

When the retardation device is used without a further pattern conditioning device, lateral or radial stress on the barrel is reduced over conventional pattern conditioning devices such as chokes in that the shot pellets are not being caused to impinge on the walls of the barrel. This extends the useful life of the barrel or barrel extension.

Also, any induced rotation of the wad/cup 26 caused by rifling or manufacturing imperfections in the gun barrel will be considerably retarded or stopped by the protuberances, thereby removing the effect of centrifugal force on the shot pellets which would otherwise cause them to disperse.

Although the present invention has been described with reference to a specific embodiment, those of skill in the art will recognize that changes may be made thereto without departing from the scope and spirit of the invention as set forth in the appended claims.

We claim as our invention:

1. A shot wad/shot cup retardation device for retarding the progression of a plastic shot wad/shot cup carrying shot pellets within a shotgun barrel that has a given diameter, comprising:

a cylindrical zone having a cylindrical wall defining diameter essentially the same as said diameter of said shotgun barrel;

a plurality of radial projections integrally formed on said wall, spaced angularly apart and projecting inwardly from said diameter;

said projections having a length along a longitudinal axis of said barrel and a width along an annular direction around said barrel, wherein said length and width do not vary greatly in dimension from one another.

2. The device according to claim 1, wherein said zone comprises an attachable barrel extension mounted to a muzzle end of the shotgun barrel.

3. A shot wad/shot cup retardation device according to claim 1, wherein said projections have a rectangular periphery defining said length and width.

4. A shot wad/shot cup retardation device according to claim 1, wherein said projections have a length and width which are substantially identical in dimension.

5. A shot wad/shot cup retardation device according to claim 1, wherein said projections are generally rectangular having a side facing an approaching cup which presents an abrupt dimensional decrease from said diameter of said shotgun barrel.

6. A shot wad/shot cup retardation device according to claim 1, including at least one gas port upstream of said projections for providing communication between atmosphere and the portion of said barrel upstream of said shot wad/shot cup as said shot wad/shot cup passes said gas port.

7. A shot wad/shot cup retardation device according to claim 1, including a shot choking device downstream of said projections.

8. A shot wad/shot cup retardation device according to claim 1, wherein said projections do not impart radial force on said shot pellets.

9. A shotgun and shell combination, comprising:

a shotgun barrel having a given diameter and a length terminating in an open muzzle and having a cup retardation zone upstream of the muzzle, the retardation zone having integrally formed radially inwardly extending protuberances; said protuberances having a length along a longitudinal axis of said barrel and a width along an annular direction around said barrel, wherein said length and width do not vary greatly in dimension from one another;

a plastic cup containing shot and adapted to carry the shot substantially the length of the barrel until reaching the cup retardation zone wherein said protuberances exert a frictional force on the cup to separate the cup and the shot held therein.

10. A shot wad/shot cup retardation device according to claim 9, wherein said protuberances have a rectangular periphery defining said length and width.

11. A shot wad/shot cup retardation device according to claim 9, wherein said protuberances have a length and width which are substantially identical in dimension.

12. A shot wad/shot cup retardation device according to claim 9, wherein said protuberances are generally rectangular having a side facing an approaching cup which presents an abrupt dimensional decrease from said diameter of said shotgun barrel.

13. A shot wad/shot cup retardation device according to claim 9, including at least one gas port upstream of said protuberances for providing communication between atmosphere and the portion of said barrel upstream of said shot wad/shot cup as said shot wad/shot cup passes said gas port.

14. A shot wad/shot cup retardation device according to claim 9, including a shot choking device downstream of said protuberances.

15. A shot wad/shot cup retardation device according to claim 9, wherein said protuberances do not impart radial force on said shot pellets.

16. A shot wad/shot cup retardation device for retarding the progression of a plastic shot wad/shot cup within a shotgun barrel having a given diameter, comprising:

a cylindrical zone having a diameter essentially the same as the diameter of said shotgun barrel;

a plurality of radial projections spaced angularly apart and projecting from said diameter into said shotgun barrel;

said projections having a length along a longitudinal axis of said barrel and a width along an annular direction around said barrel, wherein said projections have a rectangular periphery defining said length and width and have a side facing an approaching cup which presents an abrupt dimensional decrease from said diameter of said shotgun barrel.

17. A shot wad/shot cup retardation device according to claim 16, including at least one gas port upstream of said projections for providing communication between atmosphere and the portion of said barrel upstream of said shot wad/shot cup as said shot wad/shot cup passes said gas port.

18. A shot wad/shot cup retardation device according to claim 16, including a shot choking device downstream of said projections.

19. A shot wad/shot cup retardation device according to claim 16, wherein said projections do not impart radial force on said shot pellets.

* * * * *